US010823389B2

(12) United States Patent
Jiang

(10) Patent No.: US 10,823,389 B2
(45) Date of Patent: Nov. 3, 2020

(54) WATERPROOF HOUSING WITH EFFICIENT HEAT DISSIPATION AND WATERPROOF STAGE LIGHT INCLUDING THE SAME

(71) Applicant: GUANGZHOU HAOYANG ELECTRONIC CO., LTD., Guangdong (CN)

(72) Inventor: Weikai Jiang, Guangdong (CN)

(73) Assignee: GUANGZHOU HAOYUANG ELECTRONIC CO., LTD, Guangzhou (CN)

( * ) Notice: Subject to any disclaimer, the term of this patent is extended or adjusted under 35 U.S.C. 154(b) by 0 days.

(21) Appl. No.: 16/335,503

(22) PCT Filed: Aug. 11, 2017

(86) PCT No.: PCT/CN2017/097089
§ 371 (c)(1),
(2) Date: Mar. 21, 2019

(87) PCT Pub. No.: WO2018/068572
PCT Pub. Date: Apr. 19, 2018

(65) Prior Publication Data

US 2020/0018473 A1 Jan. 16, 2020

(30) Foreign Application Priority Data

Oct. 10, 2016 (CN) ..... 2016 1 0883327

(51) Int. Cl.
*F21V 31/00* (2006.01)
*F21V 29/60* (2015.01)
(Continued)

(52) U.S. Cl.
CPC ..... *F21V 31/005* (2013.01); *F21V 15/01* (2013.01); *F21V 29/60* (2015.01); *F21V 29/763* (2015.01);
(Continued)

(58) Field of Classification Search
None
See application file for complete search history.

(56) References Cited

U.S. PATENT DOCUMENTS 8,258,681 B2 * 9/2012 Lee ..... F21V 29/74 313/44
8,322,892 B2 * 12/2012 Scordino ..... F21K 9/00 362/294
(Continued)

FOREIGN PATENT DOCUMENTS

CN 104566035 A 4/2015
CN 104676551 A 6/2015
(Continued)

OTHER PUBLICATIONS

International Search Report Issued in Patent Application No. PCT/CN2017/097089 dated Nov. 13, 2017.
(Continued)

*Primary Examiner* — Vip Patel
(74) *Attorney, Agent, or Firm* — Pearne & Gordon LLP

(57) ABSTRACT

A waterproof housing with efficient heat dissipation comprises a housing body, a first end cap and a second end cap, wherein the housing body is integrally formed by brushed aluminum process, the first end cap and the second end cap are in a sealed connection with both ends of the housing body respectively, a heat dissipation channel is arranged on an inner wall of at least one side of the housing body, and an air extractor is arranged between the heat dissipation channel and an internal space of the housing body and is configured to draw airflow in the internal space of the housing body into the heat dissipation channel so as to facilitate circulation flow of the airflow between the heat dissipation channel and the internal space of the housing body. The present invention further provides a stage light
(Continued)

including a waterproof housing with efficient heat dissipation.

15 Claims, 5 Drawing Sheets

(51) Int. Cl.

| | |
|---|---|
| ***F21V 29/76*** | (2015.01) |
| ***F21V 29/83*** | (2015.01) |
| ***F21V 15/01*** | (2006.01) |
| *F21W 131/406* | (2006.01) |

(52) U.S. Cl.
CPC ..... *F21V 29/83* (2015.01); *F21W 2131/406* (2013.01)

(56) References Cited

U.S. PATENT DOCUMENTS

| | | | |
|---|---|---|---|
| 2010/0135008 | A1 | 6/2010 | Teng |
| 2012/0098429 | A1 | 4/2012 | Liang |

FOREIGN PATENT DOCUMENTS

| | | | |
|---|---|---|---|
| CN | 204593308 | U | 8/2015 |
| CN | 204879736 | U | 12/2015 |
| CN | 206112689 | U | 4/2017 |
| CN | 206112833 | U | 4/2017 |

OTHER PUBLICATIONS

Written Opinion Issued in Patent Application No. PCT/CN2017/097089 dated Nov. 13, 2017.

* cited by examiner

WATERPROOF HOUSING WITH EFFICIENT HEAT DISSIPATION AND WATERPROOF STAGE LIGHT INCLUDING THE SAME

CROSS REFERENCE TO RELATED APPLICATIONS

The present application is a continuation of International Application No. PCT/CN2017/097089, filed on Aug. 11, 2017, which claims priority from Chinese Patent Application No. 201610883327.7 filed on Oct. 10, 2016, all of which are hereby incorporated herein by reference.

TECHNICAL FIELD

The invention relates to the technical field of stage lights, in particular to a waterproof housing with efficient heat dissipation and a waterproof stage light including the same.

BACKGROUND OF THE INVENTION

The light cap body housing and the base housing of the existing waterproof stage light are both generally configurated as a sealing structure in order to provide waterproof function, but electrical components inside the light cap body and the base can generate a large amount of heat, so that the housing with sealing structure can influence the discharge of heat and further influence the using effect of the stage light.

SUMMARY OF THE INVENTION

It is therefore an object of the present invention to provide a waterproof housing with efficient heat dissipation and a waterproof stage light including the same which is free from the aforesaid drawbacks of the prior art. The present invention is simple in structure and makes the waterproof housing in sealing structure achieve an efficient heat dissipation effect, so that the stage light can achieve waterproof function without influencing the using effect.

In one aspect of the invention, a waterproof housing with efficient heat dissipation is provided, comprising a housing body, a first end cap and a second end cap, wherein the housing body is integrally formed by brushed aluminum process, the first end cap and the second end cap are in a sealed connection with both ends of the housing body respectively, a heat dissipation channel is arranged on an inner wall of at least one side of the housing body, and an air extractor is arranged between the heat dissipation channel and the internal space of the housing body (the internal space of the housing body here refers to the space inside the housing body excluding the heat dissipation channel) and is configured to draw airflow in the internal space of the housing body into the heat dissipation channel so as to facilitate circulation flow of the airflow between the heat dissipation channel and the internal space of the housing body. The air extractor causes circulation flow of the airflow in the internal space of the housing body between the heat dissipation channel and the internal space of the housing body, so that the heat conduction speed between the airflow in the internal space of the housing body and the housing body is accelerated to quickly conduct the heat generated by electrical components in the housing body out of the housing body.

Further, the heat dissipation channel includes channel spacer plates and a channel cover plate, wherein the channel spacer plates are arranged in parallel to each other on the inner wall of the housing body with adjacent channel spacer plates spaced apart at regular intervals, the channel cover plate covers the channel spacer plates, and the air extractor is positioned on the channel cover plate. The length of the channel spacer plates corresponds to the length of the housing body, and the length of the channel cover plate is less than the length of the housing body. In this way, the heat dissipation channel is formed on the inner wall of the housing body by the inner wall of the housing body, the channel spacer plates and the channel cover plate, both ends of the heat dissipation channel and the positions provided with the air extractor are communicated with the internal space of the housing body, and other parts of the heat dissipation channel are spaced apart from the internal space of the housing body. The air extractor draws the airflow in the internal space of the housing body into the heat dissipation channel, therefore the heat generated by the electrical components in the housing body enters the heat dissipation channel along with the airflow, and the airflow diffuses to both ends of the heat dissipation channel after entering the heat dissipation channel. During the airflow diffusion process, the heat carried by the airflow is transferred to the housing body through heat conduction, and the airflow returns to the internal space of the housing body when diffusing to both ends of the heat dissipation channel, so that the circulation flow can transfer the heat in the housing body to the housing body continuously and rapidly, and the housing body dissipates the heat into the outside air at last. Preferably, the air extractor is a blower or a fan.

Further, grooves having shapes corresponding to the end face shapes of both ends of the housing body are respectively arranged on the first end cap and the second end cap, sealing rings are respectively arranged between both ends of the housing body and the first end cap and the second end cap, and the sealing rings are arranged in the grooves, so that external water can be effectively prevented from entering the inside of the housing body.

Further, heat dissipation fins are arranged on an outer wall of the housing body, which can make the heat in the housing body dissipate to outside faster.

In another aspect of the invention, a waterproof stage light including a waterproof housing with efficient heat dissipation is provided, comprising a light cap body, a U-shaped supporting frame and a base, wherein the light cap body is rotationally connected to the U-shaped supporting frame, the U-shaped supporting frame is rotationally connected to the base, and the light cap body and/or the base includes the above-mentioned waterproof housing.

Further, a mounting hole for connecting the U-shaped supporting frame is arranged on the waterproof housing of the light cap body and/or the base, and the U-shaped supporting frame is in rotationally sealed connection with the mounting hole. Preferably, the U-shaped supporting frame is in rotationally sealed connection with the mounting hole through a waterproof rotating shaft. The waterproof rotating shaft includes a hollow rotating shaft body and a waterproof connector. One end of the waterproof connector is provided with a connecting part, and the other end of the waterproof connector is provided with a guide pipe through which a wire for connecting the light cap body and the base of the stage light passes. The wire connecting the base and the light cap body of the stage light starts from the inside of the stage light base and sequentially passes through the hollow rotating shaft body connected to the base, the waterproof connector and the guide pipe, and then passes through the waterproof connector connected to the light cap body and the hollow rotating shaft body to enter into the light cap body of the stage light. In such way, the wires connecting the base and the light cap body of the stage light are all in a sealed environment. Compared with a traditional stage light, the external water can be prevented from entering the light cap body and the base of the stage light from the hollow rotating shaft body through which the wire passes. At least one annular groove is formed on the connecting part, the annular groove is provided with an annular sealing ring, and the connecting part is inserted in the hollow rotating shaft body. The annular sealing ring is closely attached to the inner wall of the hollow rotating shaft body, thus further increasing the sealing performance of the connection between the waterproof connector to connect with the hollow rotating shaft body.

Further, a handle is arranged on the waterproof housing of the base for convenient carrying.

Compared with the prior art, certain beneficial effects of the present invention can be obtained.

According to the present invention, a heat dissipation channel is arranged on the inner wall of the housing body of the waterproof housing, and an air extractor is arranged on the heat dissipation channel. In such configuration, the air extractor draws the airflow in the internal space of the housing body into the heat dissipation channel, therefore, the heat generated by the electrical components in the housing body enters the heat dissipation channel along with the airflow, and the airflow diffuses to both ends of the heat dissipation channel after entering the heat dissipation channel. During the airflow diffusion process, the heat carried by the airflow is transferred to the housing body through heat conduction mode, and the airflow returns to the internal space of the housing body when diffusing to both ends of the heat dissipation channel, so that the circulation flow can transfer the heat in the housing body to the housing body continuously and rapidly, and the housing body dissipates the heat into the outside air. Therefore, the invention is simple in structure and makes the waterproof housing in sealing structure achieve an efficient heat dissipation effect, so that the stage light can achieve waterproof function without influencing the using effect of the stage light.

DESCRIPTION OF EMBODIMENTS

Figure 1:
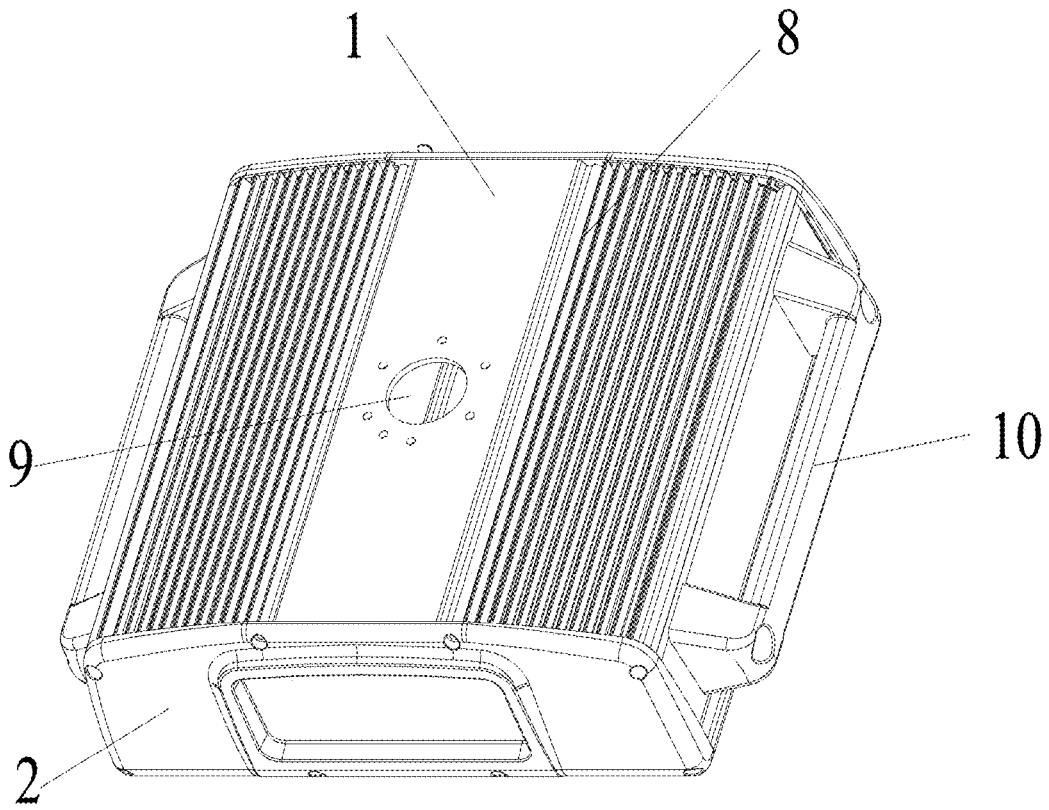
FIG. 1 is a schematic structural diagram of a waterproof housing according to the present invention.

The drawings are for illustration purpose only and are not intended to limit the present invention. Some components in the drawings may be omitted, enlarged, or reduced for better illustrating the embodiments, and sizes of these components do not represent sizes of actual product. For those skilled in the art, it will be understood that some known structures in the drawings and descriptions thereof may be omitted. The positional relationships described in the drawings are for illustration purpose only and are not intended to limit the present invention.

Embodiment 1

Figure 2:
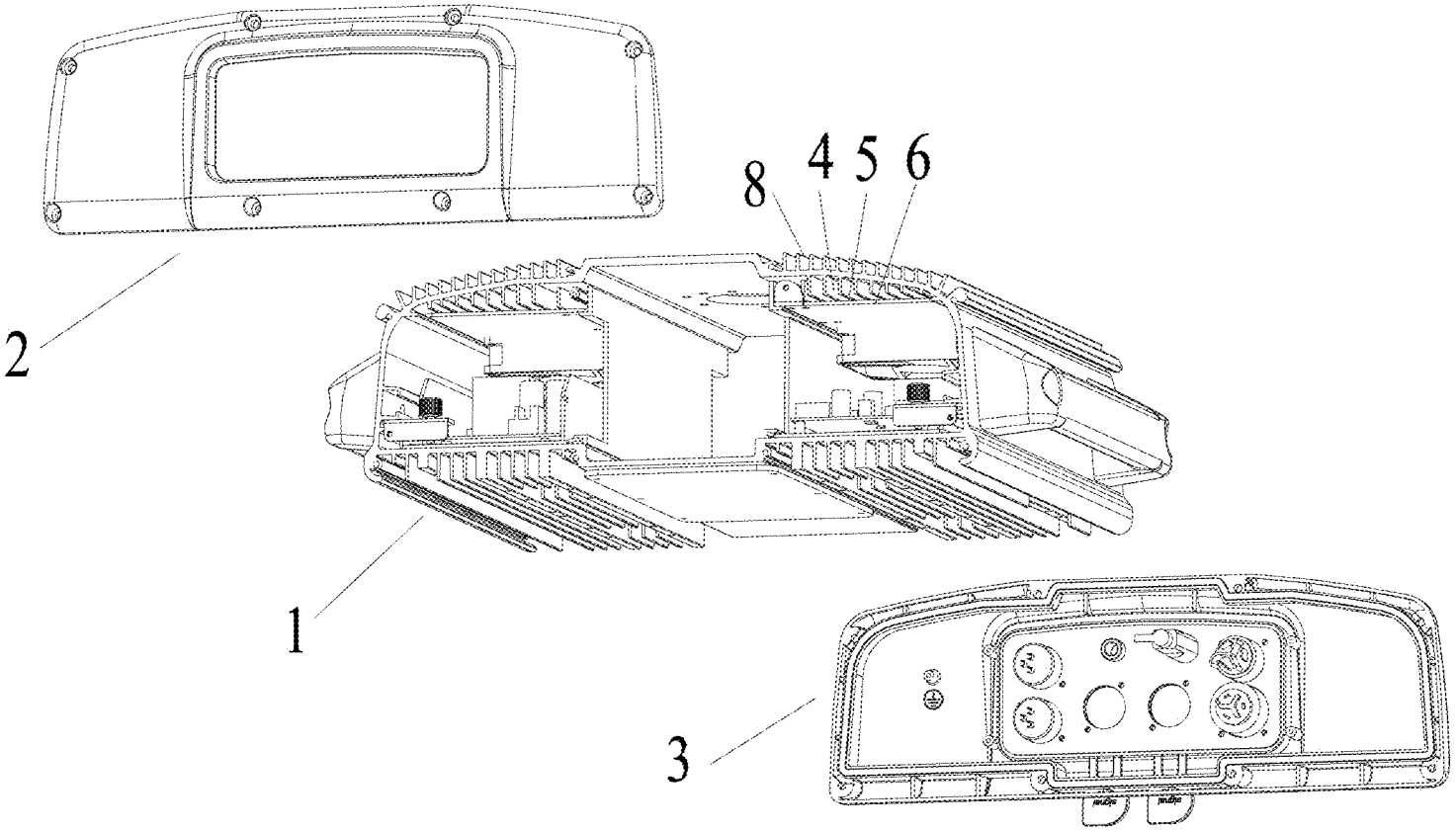
FIG. 2 is an exploded view of FIG. 1.
Figure 3:
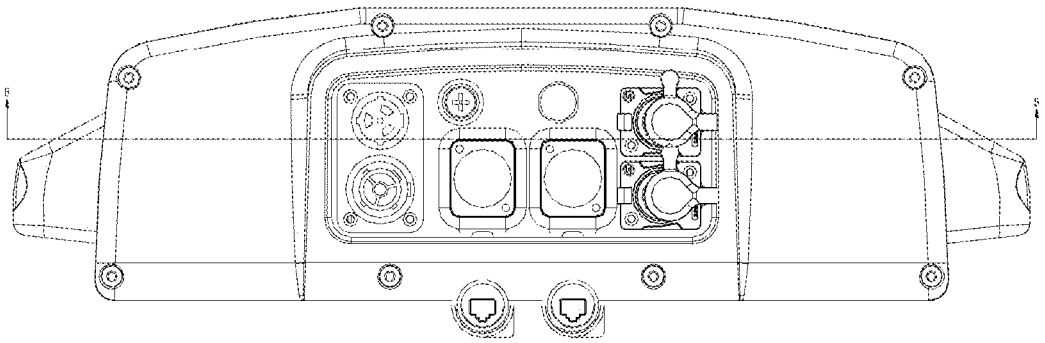
FIG. 3 is a schematic diagram of an end structure of the waterproof housing according to the present invention.

As shown in FIGS. 1 to 3, a waterproof housing with efficient heat dissipation according to the present embodiment comprises a housing body 1, a first end cap 2 and a second end cap 3, wherein the housing body 1 is integrally formed by brushed aluminum process, the first end cap 2 and the second end cap 3 are in a sealed connection with both ends of the housing body 1 respectively, a heat dissipation channel 4 is arranged on an inner wall of at least one side of the housing body 1, and an air extractor 15 is arranged between the heat dissipation channel 4 and the internal space of the housing body 1 (the internal space of the housing body 1 here refers to the space inside the housing body 1 excluding the heat dissipation channel 4) and is configured to draw airflow in the internal space of the housing body 1 into the heat dissipation channel 4 so as to facilitate circulation flow of the airflow between the heat dissipation channel 4 and the internal space of the housing body 1. In such configuration, the air extractor 15 causes circulation flow of the airflow in the internal space of the housing body 1 between the heat dissipation channel 4 and the internal space of the housing body 1, so that the heat conduction speed between the airflow in the internal space of the housing body 1 and the housing body 1 is accelerated to quickly conduct the heat generated by electrical components in the housing body 1 out of the housing body 1.

Figure 4:
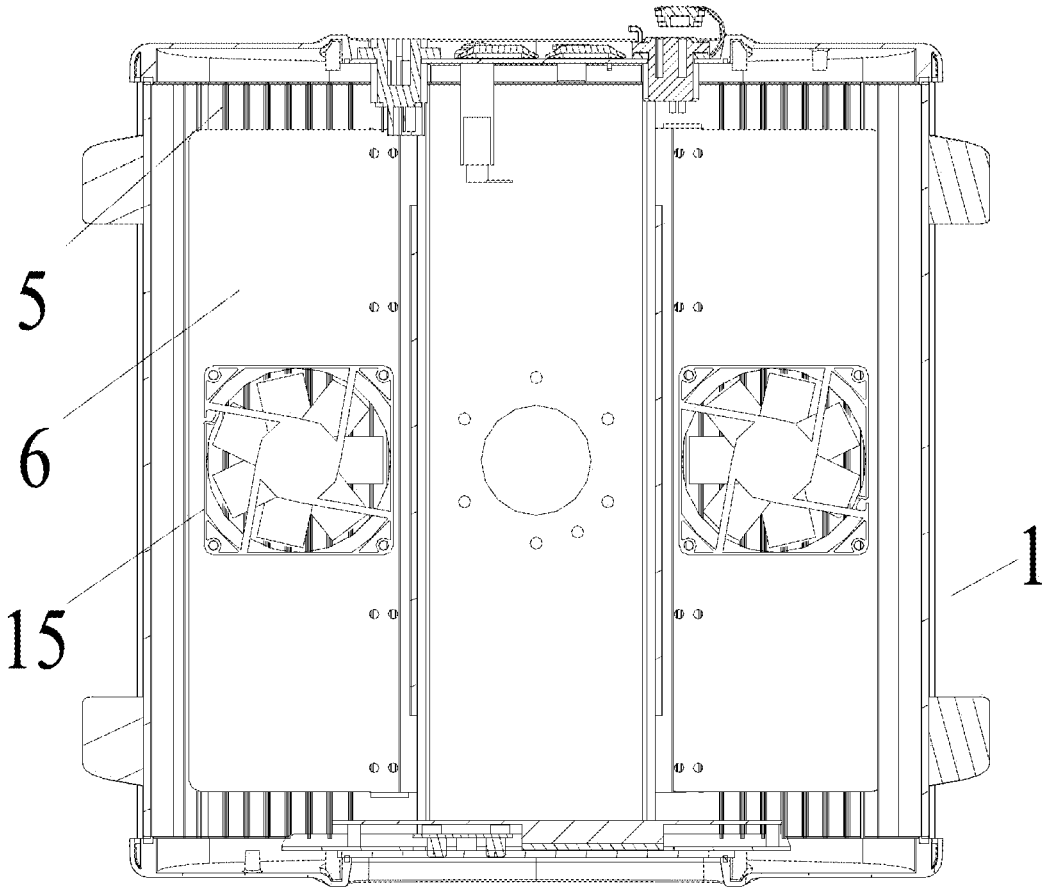
FIG. 4 is a cross-sectional view of B-B in FIG. 3.

As shown in FIG. 4, the heat dissipation channel 4 includes channel spacer plates 5 and a channel cover plate 6, wherein the channel spacer plates 5 are arranged in parallel to each other on the inner wall of the housing body 1 with adjacent channel spacer plates 5 spaced apart at regular intervals, the channel cover plate 6 covers the channel spacer plates 5, and the air extractor 15 is positioned on the channel cover plate 6. The length of the channel spacer plates 5 corresponds to the length of the housing body 1, and the length of the channel cover plate 6 is less than the length of the housing body 1. In this way, the heat dissipation channel 4 are formed on the inner wall of the housing body 1 by the inner wall of the housing body 1, the channel spacer plates 5 and the channel cover plate 6, both ends of the heat dissipation channel 4 and the positions provided with the air extractor 15 are communicated with the internal space of the housing body 1, and other parts of the heat dissipation channel 4 are spaced apart from the internal space of the housing body 1. The air extractor 15 draws the airflow in the internal space of the housing body 1 into the heat dissipation channel 4, therefore, the heat generated by the electrical components in the housing body 1 enters the heat dissipation channel 4 along with the airflow, and the airflow diffuses to both ends of the heat dissipation channel 4 after entering the heat dissipation channel 4. During the airflow diffusion process, the heat carried by the airflow is transferred to the housing body 1 through heat conduction, and the airflow returns to the internal space of the housing body 1 when diffusing to both ends of the heat dissipation channel 4, so that the circulation flow can transfer the heat to the housing body 1 continuously and rapidly, and the housing body 1 dissipates the heat into the outside air at last. Preferably, the air extractor 15 is a blower or a fan.

Figure 5:
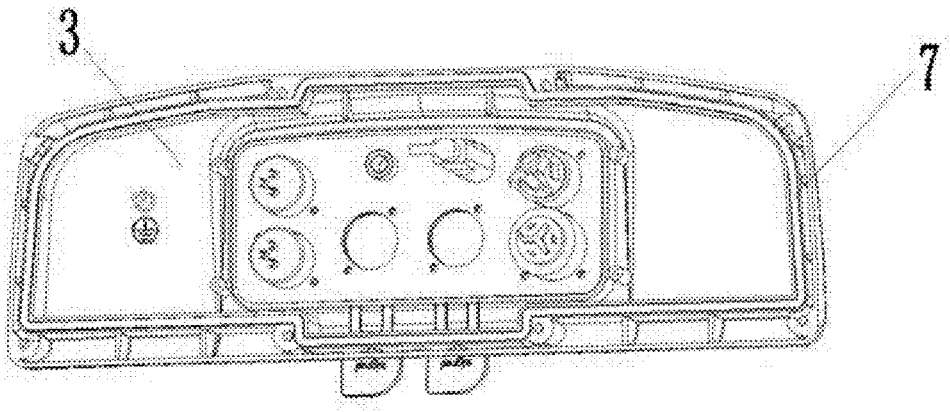
FIG. 5 is a schematic structural diagram of a first end cap and a second end cap according to the present invention.

As shown in FIG. 5, grooves 7 having shapes corresponding to the end face shapes of both ends of the housing body 1 are respectively arranged on the first end cap 2 and the second end cap 3, sealing rings are respectively arranged between both ends of the housing body 1 and the first end cap 2 and the second end cap 3, and the sealing rings are arranged in the grooves 7, so that external water can be effectively prevented from entering the inside of the housing body 1.

As shown in FIGS. 1 and 2, heat dissipation fins 8 are arranged on the outer wall of the housing body 1, which can make the heat in the housing body dissipate to outside faster.

Embodiment 2

A waterproof stage light including a waterproof housing with efficient heat dissipation comprises a light cap body, a U-shaped supporting frame and a base, wherein the light cap body is rotationally connected to the U-shaped supporting frame, the U-shaped supporting frame is rotationally connected to the base, and the light cap body and/or the base includes the waterproof housing described in the embodiment 1.

Figure 6:
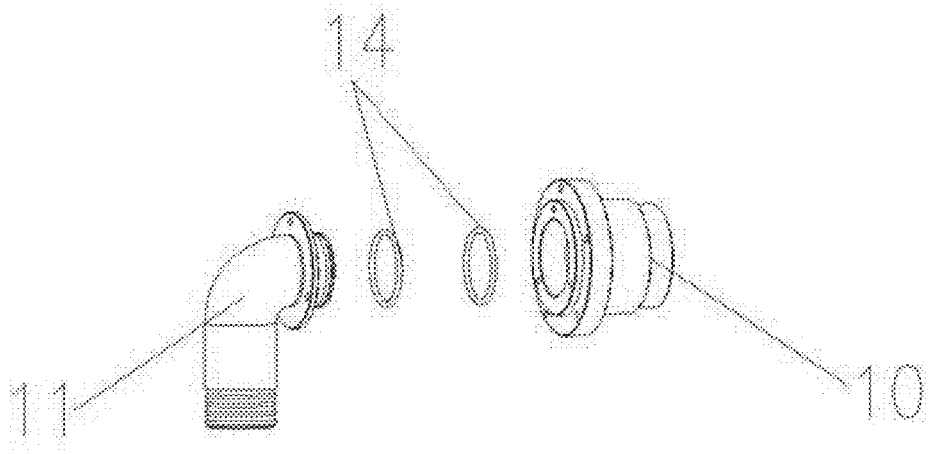
FIG. 6 is a schematic structural diagram of a waterproof rotating shaft according to the present invention.
Figure 7:
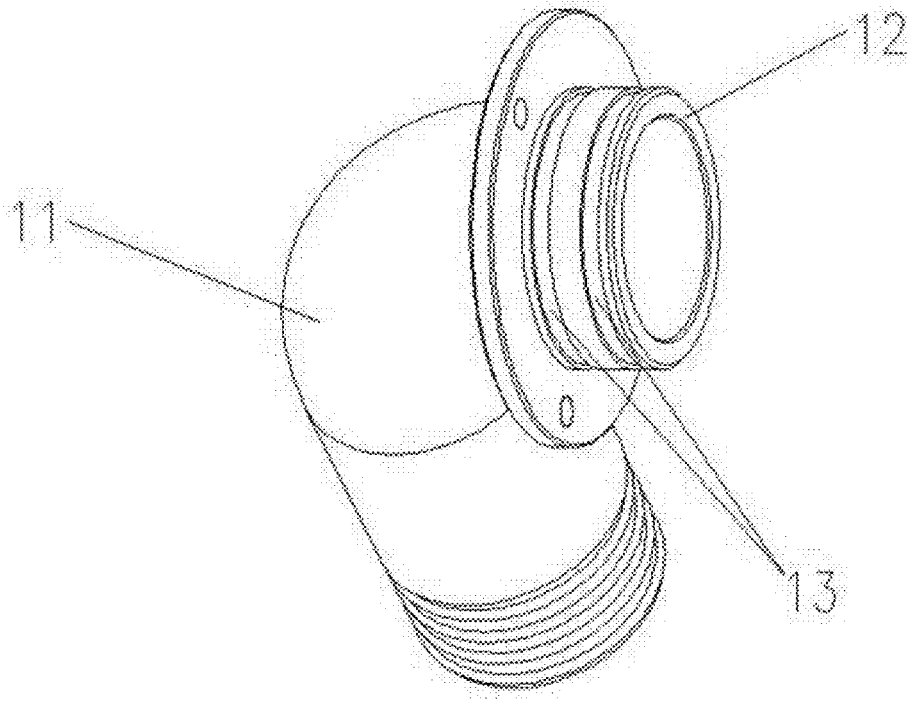
FIG. 7 is a schematic structural diagram of a waterproof connector according to the present invention.

As shown in FIGS. 1, 6 and 7, a mounting hole 9 for connecting the U-shaped supporting frame is arranged on the waterproof housing of the light cap body and/or the base, and the U-shaped supporting frame is in rotationally sealed connection with the mounting hole 9 through a waterproof rotating shaft. The waterproof rotating shaft includes a hollow rotating shaft body 10 and a waterproof connector 11. One end of the waterproof connector 11 is provided with a connecting part 12, and the other end of the waterproof connector 11 is provided with a guide pipe through which a wire for connecting the light cap body and the base of the stage light passes. The wire connecting the base and the light cap body of the stage light starts from the inside of the stage light base and sequentially passes through the hollow rotating shaft body 10 connected to the base, the waterproof connector 11 and the guide pipe, and then passes through the waterproof connector 11 connected to the light cap body and the hollow rotating shaft body 10 to enter into the light cap body of the stage light. In such way, the wires connecting the base and the light cap body of the stage light are all in a sealed environment. Compared with a traditional stage light, the external water can be prevented from entering the light cap body and the base of the stage light from the hollow rotating shaft body 10 through which the wire passes. At least one annular groove 13 is formed on the connecting part 12, the annular groove 13 is provided with an annular sealing ring 14, and the connecting part 12 is inserted in the hollow rotating shaft body 10. The annular sealing ring 14 is closely attached to the inner wall of the hollow rotating shaft body 10, thus further increasing the sealing performance of the connection between the waterproof connector 11 and the hollow rotating shaft body 10.

As shown in FIG. 1, a handle 16 is arranged on the waterproof housing of the base for convenient carrying.

Obviously, the above embodiments of the invention are merely examples for clear illustration of the invention, and are not intended to limit the implementation of the invention. Modifications or changes in other various forms can be made by those ordinary skilled in the art on the basis of the above description. There is neither need nor exhaustion for all implementations. Any modification, equivalent substitution, improvement, or the like within the spirit and principle of the invention should be included in the scope of the claims of the invention.

The invention claimed is:

1. A waterproof housing with efficient heat dissipation, comprising:

a housing body, which is integrally formed;

a first end cap; and a second end cap, wherein the first end cap and the second end cap are in a sealed connection with both ends of the housing body respectively, a heat dissipation channel is arranged on at least one inner lateral wall of the housing body, and an air extractor is arranged between the heat dissipation channel and an internal space of the housing body and is configured to draw airflow in the internal space of the housing body into the heat dissipation channel so as to facilitate circulation flow of the airflow between the heat dissipation channel and the internal space of the housing body.

2. The waterproof housing with efficient heat dissipation according to claim 1, wherein the heat dissipation channel includes channel spacer plates in parallel to each other on the inner lateral wall of the housing body with adjacent channel spacer plates spaced apart at regular intervals; and a channel cover plate covering on the channel spacer plates, on which the air extractor is arranged.

3. The waterproof housing with efficient heat dissipation according to claim 2, wherein a length of the channel spacer plates corresponds to a length of the housing body, and a length of the channel cover plate is less than a length of the housing body.

4. The waterproof housing with efficient heat dissipation according to claim 1, wherein the air extractor is a blower or a fan.

5. The waterproof housing with efficient heat dissipation according to claim 1, wherein grooves having shapes corresponding to end face shapes of both ends of the housing body are respectively arranged on the first end cap and the second end cap, sealing rings are respectively arranged between both ends of the housing body and the first end cap and the second end cap, and the sealing rings are arranged in the grooves.

6. The waterproof housing with efficient heat dissipation according to claim 1, wherein heat dissipation fins are arranged on an outer lateral wall of the housing body.

7. A waterproof stage lamp including a waterproof housing with efficient heat dissipation, comprising:

a lamp cap body;

a U-shaped supporting frame rotationally connected to the lamp cap body; and a base rotationally connected to the U-shaped supporting frame, wherein the lamp cap body and/or the base includes the waterproof housing according to claim 1.

8. The waterproof stage lamp according to claim 7, wherein the heat dissipation channel includes channel spacer plates in parallel to each other on the inner lateral wall of the housing body with adjacent channel spacer plates spaced apart at regular intervals; and a channel cover plate covering on the channel spacer plates, on which the air extractor is arranged.

9. The waterproof stage lamp according to claim 8, wherein a length of the channel spacer plates corresponds to a length of the housing body, and a length of the channel cover plate is less than a length of the housing body.

10. The waterproof stage lamp according to claim 7, wherein the air extractor is a blower or a fan.

11. The waterproof stage lamp according to claim 7, wherein grooves having shapes corresponding to end face shapes of both ends of the housing body are respectively arranged on the first end cap and the second end cap, sealing rings are respectively arranged between both ends of the housing body and the first end cap and the second end cap, and the sealing rings are arranged in the grooves.

12. The waterproof stage lamp according to claim 7, wherein heat dissipation fins are arranged on an outer lateral wall of the housing body.

13. The waterproof stage lamp according to claim 7, wherein a mounting hole for connecting the U-shaped supporting frame is arranged on the waterproof housing of the lamp cap body and/or the base, and the U-shaped supporting frame is in rotationally sealed connection with the mounting hole.

14. The waterproof stage lamp according to claim 13, wherein the U-shaped supporting frame is in rotationally sealed connection with the mounting hole through a waterproof rotating shaft.

15. The waterproof stage lamp according to claim 14, wherein the waterproof rotating shaft includes a hollow rotating shaft body; and a waterproof connector, one end of the waterproof connector being provided with a connecting part inserted in the hollow rotating shaft body, and the other end being provided with a guide pipe through which a wire for connecting the lamp cap body and the base of the stage lamp passes, and wherein at least one annular groove provided with an annular sealing ring is formed on the connecting part.

* * * * *